United States Patent [19]

Pritchett

[11] 4,197,444

[45] Apr. 8, 1980

[54] A.C./D.C. SOLENOID DRIVE CIRCUIT

[75] Inventor: Wayne W. Pritchett, Newtown, Conn.

[73] Assignee: Pitney-Bowes, Inc., Stamford, Conn.

[21] Appl. No.: 901,889

[22] Filed: May 1, 1978

[51] Int. Cl.[2] ..... H05B 1/00

[52] U.S. Cl. ..... 219/216; 219/388; 361/194

[58] Field of Search ..... 219/216, 388; 355/3 FU; 361/194, 196, 202, 154

[56] References Cited

U.S. PATENT DOCUMENTS

| | | | |
|---|---|---|---|
| 2,410,183 | 10/1946 | Ray | 361/154 |
| 3,746,834 | 7/1973 | Purps | 219/216 |

FOREIGN PATENT DOCUMENTS

| | | | |
|---|---|---|---|
| 1115833 | 2/1959 | Fed. Rep. of Germany | 361/194 |
| 1093874 | 12/1960 | Fed. Rep. of Germany | 361/194 |
| 842911 | 7/1960 | United Kingdom | 219/388 |

*Primary Examiner*—C. L. Albritton

*Attorney, Agent, or Firm*—Lawrence E. Sklar; William D. Soltow, Jr.; Albert W. Scribner

[57] ABSTRACT

A solenoid drive circuit to enhance the operation of an alternating current solenoid. The circuit supplies alternating current to the solenoid when its plunger is in an extended position and then switches to a direct current when the plunger is in its home position, thereby eliminating any buzzing due to plunger misalignment or other inherent characteristics of the solenoid or associated mechanism and drawing less power than if it was being held in its home position with alternating current voltage. The invention has wide applicability but is disclosed herein in association with the operation of a fail-safe device, particularly a device to prevent fires from starting in a radiant energy fixer of an electrostatic copying machine in the event of a sudden loss of power.

3 Claims, 2 Drawing Figures

A.C./D.C. SOLENOID DRIVE CIRCUIT

FIELD OF THE INVENTION

The present invention relates to solenoid drive circuits and more particularly to a solenoid drive circuit that supplies A.C. voltage to a solenoid when its plunger is extended and D.C. voltage when its plunger is in its home position.

BACKGROUND OF THE INVENTION

Business machines, home applicances, and other types of equipment use solenoids to convert electrical power into mechanical motion. Generally, they use alternating current (A.C.) solenoids because of the availability of A.C. power from wall outlets. The primary fault with A.C. solenoids is the buzzing when the plunger is retracted into its home position. Diswashers, washing machines and office equipment are characterized by noisy solenoids, which is a distraction for prople that have to work around them.

Direct current (D.C.) solenoids, on the other hand, do not exhibit this buzzing when their plungers are retracted into their home positions. It is known to those skilled in the art, that inch per inhc an A.C. solenoid has more pull-in force when the plunger is extended than a D.C. solenoid and to obtain equivalent pull-in force, the D.C. solenoid is going to be considerably larger than the A.C. solenoid, and will also require a more powerful D.C. power supply. Conversely, it is known that inch per inch a D.C. solenoid has a higher hold-in force than an A.C. solenoid of equivalent structure.

In most business machines and primarily electrophotographic copy machines that incorporate a radiant energy type fixing device, a fail-safe safety system is used to prevent fires or some other type of event that could be dangerous to the personnel in the area and or the machine. These safety systems have some mechanism that is normally biased to a safety position so that if power is interrupted the mechanism will always move to this position to prevent a particular catastrophic event. A solenoid is usually employed to move the mechanism from this safety position to an operative position so that the machine can perform its function. In the case of copy machines using radiant energy type fixing devices, the solenoid is energy to hold the safety mechanism in its operative position throughout the entire working day so that the copy machine is always in a mode to make copies without a long warm up time. Generally A.C. solenoids are used in this type of application because of their high pull-in force needed to overcome the biasing means that pulls the mechanism into its safety position and because A.C. solenoids will dissipate less power in the home position than comparable D.C. solenoids. The buzzing characteristic of A.C. solenoids is very distracting for people that have to work around the equipment, especially in an office environment where a noisy copier can lower the efficiency of the office staff. Therefore it would be very desirable in a fail-safe safety system, to have a solenoid and or its driving circuit that would have the pull-in force characteristic of an A.C. solenoid, the hold-in force and quietness of a D.C. solenoid with the lowest power dissipation possible when the solenoid plunger is in its home position.

SUMMARY OF THE INVENTION

The present invention has as an object, the elimination of the aforementioned drawbacks, inherent with conventional A.C. and D.C. solenoids, in that it provides a driving circuit for a solenoid to give the solenoid a high pull-in force when the plunger of the solenoid is extended, to provide a high hold-in force when the plunger is retracted into the solenoid at its home position and while in the home position to keep the solenoid from buzzing.

Another object of the present invention is to provide a drive circuit for an A./C. solenoid in a fail-safe application where the circuit applies A.C. voltage to the solenoid when the plunger is in an extended position, thereby giving the solenoid the highest pull-in power, then switches to D.C. when the plunger is fully retracted to hold the plunger in its home position without buzzing and drawing less power than if it was being held in the home position with an A.C. voltage.

Other objects and advantages of the present invention will become apparent upon reading the following detailed descrioption and upon reference to the drawings.

DESCRIPTION OF THE PREFERRED EMBODIMENT

Figure 1:
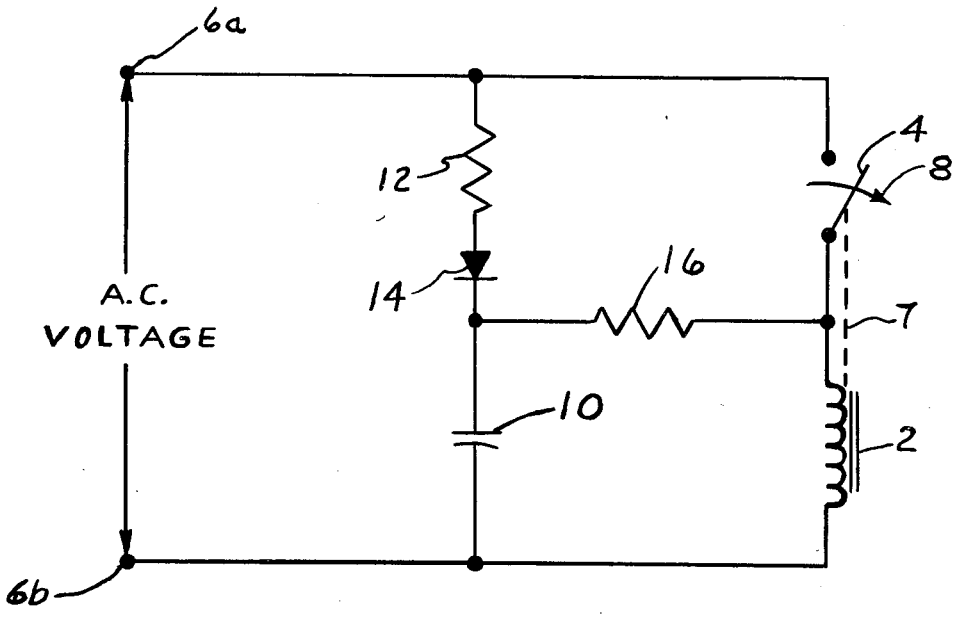
FIG. 1 is the schematic of the present invention.

Referring to FIG. 1, in which the present invention is illustrated, an A.C. solenoid 2 is connected in series with a normally closed home position switch 4 to an A.C. voltage source applied at *6a* and *6b*. When the A.C. voltage is applied to connections *6a* and *6b*, A.C. current will flow through the closed switch 4 to energize the solenoid, thereby pulling the plunger of the solenoid to a retracted position.

The normally closed switch 4 is mechanically tied as indicated by the numeral 7 to the plunger of the solenoid. This mechanical tie will open the switch by rotating the switch contact to an open position as indicated by the arrow 8 when the plunger reaches its fully retracted position or home position; therefore, when the plunger is in any position except the home position, switch 4 is closed and A.C. voltage is supplied to solenoid 2.

When the plunger of solenoid 2 is in its home position, switch 4 is open. Capacitor 10 is charged by the series combination of resistor 12 and diode 14 to form a D.C. bias on the capacitor 10. Resistor 16 connected between the capacitor 10 and solenoid 2 supplies to the solenoid a D.C. voltage. When switch 4 is closed, the above D.C. supply circuit segment is non-operative and an A.C. voltage is supplied to the solenoid. When the home position switch is open, the D.C. voltage supply circuit is operative and supplies D.C. voltage to the solenoid and the A.C. voltage supply segment is non-operative.

The aforementioned solenoid drive circuit gives the best advantages of both A.C. and D.C. solenoids in that when the plunger is extended out of the solenoid 2, the home position switch 4 is closed, thereby supplying A.C. current to the solenoid which gives the solenoid its characteristic pulling force. When the plunger of solenoid 2 reaches the home position, the home position switch 4 opens and the D.C. supply circuit section is operative and supplies a D.C. voltage to the solenoids, which gives the solenoid a high hold-in force without the buzzing that is common to A.C. solenoids supplied with A.C. voltage with their plunger in the home position.

Selection of the values of the various components in the drive circuit is strictly dependent on the application intended for the solenoid. For instance, the size of the A.C. solenoid has to be sufficient to pull in its plunger with the force required under A.C. voltage. The value of the resistors and capacitor should be such that the magnitude of the D.C. voltage is sufficient to hold the plunger in the home position, with the maximum amount of ripple to keep the solenoid from buzzing. The above criteria will maximize the performance of the solenoid with respect to pull-in and hold-in forces, minimum power dissipation when the plunger is in its home position and with no buzzing.

The following example illustrates an application of the present invention used in conjunction with a fail-safe system in a radiant energy fixing device for an electrophotographic copy machine and is not to be construed as limiting.

Figure 2:
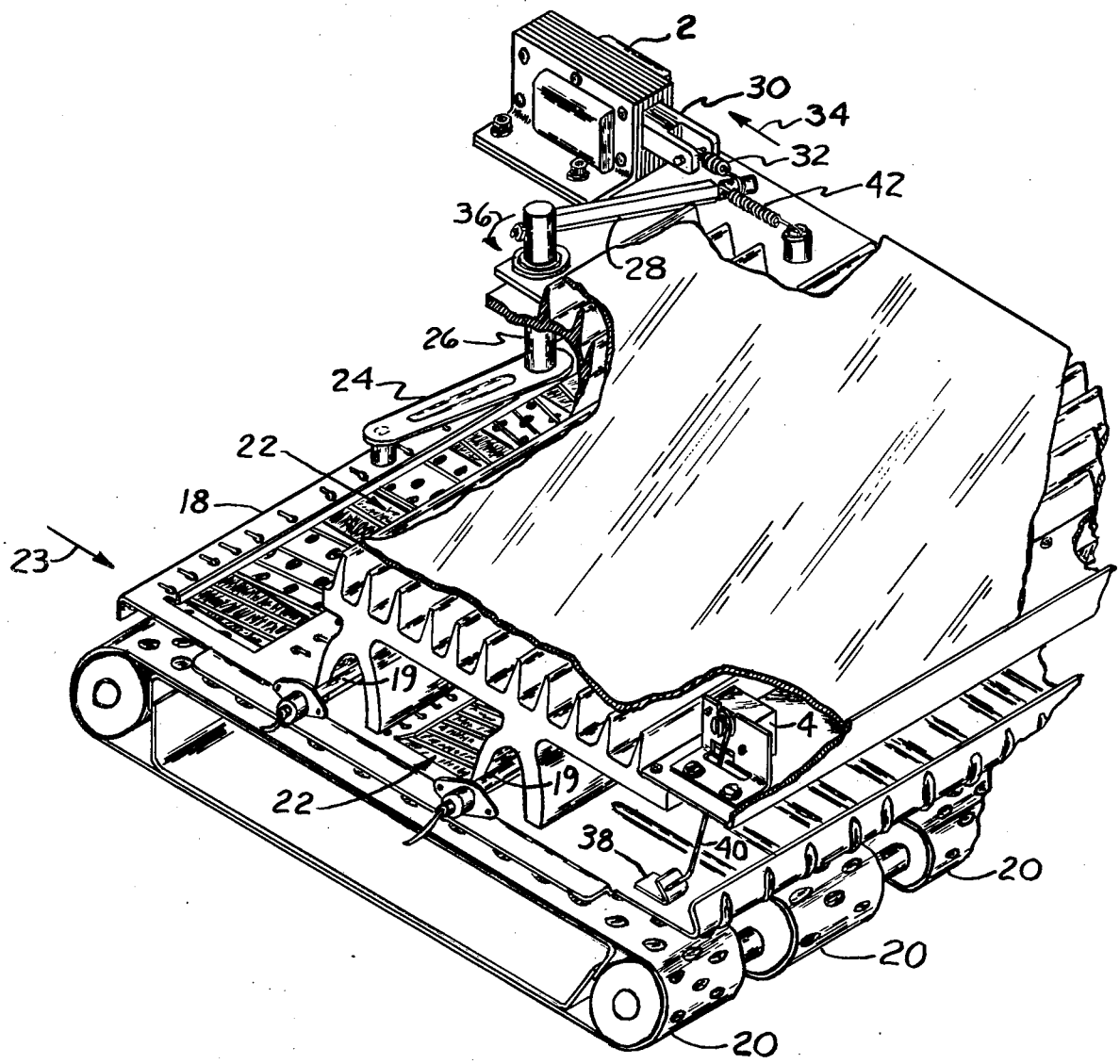
FIG. 2 is a perspective view of a radiant energy fixing device for an electrophotographic copy machine, incorporating the present invention.

Referring to FIG. 2, a pair of infrared heaters 19 is mounted above a series of sheet transport belts 20. When a sheet having an image formed of heat fixable toner is moved under the infrared heaters 19 on the transport belts 20, the toner is permanently fixed to the sheet.

Shutter 18, that slides back and forth below the infrared heaters 19 and above the sheet transport belts 20, is shown in a safety position where windows 22 in the shutter 18 are displaced away from the infrared heaters 19 to prevent any radiant heat from reaching the transport belts 20 and any sheet that may be on the belts. In the operational position shutter 18 is translated, as indicated by arrow 23, until the windows 22 are under the infrared heaters 19 so that the radiating heat can reach the transport belts 20 and sheets that are moving on the belts.

Arm 24, that is pivotally attached to shutter 18 and rigidly attached to shaft 26, translates the shutter 18 in the direction as indicated by arrow 23 when the shaft 26 is rotated in the direction that is indicated by arrow 36. Arm 28, rigidly attached to shaft 26 and connected to solenoid plunger 30 of solenoid 2 by take up spring 32, rotates shaft 26 in the direction indicated by arrow 36 when the plunger moves in the direction indicated by arrow 34. Return spring 42 attached to arm 28 biases the arm 28 in the direction opposite to that of arrow 34.

In operation, when power is applied to the fixing device the solenoid 2 pulls the plunger 30 to its fully retracted home position in the direction indicated by arrow 34. The take up spring 32 pulls arm 28 in the direction indicated by arrow 34 which extends the return spring 42 and rotates shaft 26 in the direction indicated by arrow 36. Arm 24 translates the shutter 18 in the direction indicated by arrow 23 to the operative position where windows 22 are under the infrared heaters 19. When power is removed the force holding the plunger 30 into solenoid 2 is removed. The return spring 42 moves the arm 28 in a direction opposite to that indicated by arrow 34. Shaft 26 is rotated in a direction opposite to that indicated by arrow 36 and arm 24 translates the shutter in a direction opposite to that indicated by arrow 23 to the safety position where windows 22 of the shutter are displaced away from the infrared heaters 19. Therefore it should be evident that when the fixing device is energized the solenoid 2 translates the shutter to the operative position and when the fixing device is deenergized the return spring 42 translates the shutter to a safety position.

Because the rate of making copies is relatively fast, the intensity of the infrared heaters are generally high so that the toner on the sheet passing under the infrared heaters can be fixed in the short time that is available. Infrared heaters also radiate residual heat when they are turned off which makes a dangerous situation in the event of a power failure. If a shutter and translating means as described above is not incorporated in a radiant energy fixing device, a sheet that may be in the fixing device could be ignited from the high intensity residual heat if power was interrupted. Therefore the shutter and associated translation means is a fail-safe safety system to prevent heat from radiating from the infrared heaters to the belts and sheets on the belt when power to the fixing device is interrupted.

When power is first applied to the fixing device, switch 4 is closed thereby supplying A.C. voltage to solenoid 2. This gives solenoid 2 the greatest pull-in force to overcome the force exerted by return spring 42 and translate the shutter to the operational position. Once the solenoid plunger reaches its fully retracted home position and the shutter reaches its operational position tab 38 mounted on the shutter engages switch actuator 40 that opens switch 4. This deactivates the A.C. voltage supply circuit segment and activates the D.C. voltage supply circuit segment.

With D.C. voltage now being supplied to solenoid 2 it can hold the plunger 30 with a high hold-in force, low power dissipation and no buzzing.

The preceding example clearly describes an application of the present invention in that, the driving circuit of the solenoid provides A.C. voltage to the solenoid in order to translate the shutter from its safety position to its operational position. The use of A.C. voltage gives the solenoid sufficient pull-in force when the plunger is extended, to overcome the return spring force that biases the shutter in its safety position. Once the shutter reaches the operational position, the driving circuit energizes the solenoid with D.C. voltage in order to have a high hold-in force without any buzzing and at a lower power level. This is a tremendous benefit with copy machines that incorporate this type of fixing device, in that the fixing device is generally left on during the work day, so that it will maintain a certain temperature for proper fixing of toner on to copy sheets and it would be very distracting having to listen to a buss all day.

What is claimed is:

1. In an electrophotographic copy machine, a radiant energy thermal fusing apparatus for fixing thermally fusible toner onto a copy sheet, said fusing apparatus comprising:

A. a radiant infrared heat source;

B. means positioned under said infrared heat source for transporting a copy sheet bearing thermally fusible toner;

C. a shutter slidably mounted between said infrared heat source and said sheet transport means, said shutter having an open position wherein radiant heat passes through the shutter to the copy sheet and a closed position wherein radiant heat is blocked from passing through the shutter;

D. means for biasing the shutter in said closed position;

E. an A.C. voltage source;

F. a D.C. voltage source;

G. a solenoid electrically connectable to said A.C. and said D.C. voltage sources for generating an electromagnetic field, said solenoid having a plunger movably mounted therein and coupled to said shutter; and H. a switch electrically connected to said solenoid and coupled to said plunger for electrically connecting said solenoid to said A.C. voltage source when said shutter is closed and for electrically connecting said solenoid to said D.C. voltage source when said shutter is open, whereby the shutter is initially opened by the plunger when the solenoid is connected to the A.C. voltage source and the shutter is held in the open position when the solenoid is connected to the D.C. voltage source and the shutter is biased closed when no voltage is applied to the solenoid.

2. The invention of claim 1 wherein said solenoid is an A.C. solenoid.

3. The invention of claim 1 wherein said plunger partially extends outside the solenoid when the shutter is closed and said plunger is retracted inside said solenoid when the shutter is open.

* * * * *

UNITED STATES PATENT AND TRADEMARK OFFICE

CERTIFICATE OF CORRECTION

PATENT NO. : 4,197,444

DATED : April 8, 1980

INVENTOR(S) : Wayne W. Pritchett

It is certified that error appears in the above—identified patent and that said Letters Patent is hereby corrected as shown below:

Column 1, line 19 change "Diswashers" to -- Dishwashers --.

Column 1, line 21 change"prople" to -- people --.

Column 1, line 26 after the word "per" change "inhc" to -- inch--

Columnl, lines 39 and 64 change "and or" to -- and/or --.

Column 1, line 48 change "energy" to -- energized --.

Column 2, line 13 change "A./C." to -- A.C. --.

Column 2, line 23 change "descrioption" to -- description --.

Column 4, line 52 change "buss" to -- buzz --.

Signed and Sealed this

*Third* Day of *November 1981*

[SEAL]

*Attest:*

GERALD J. MOSSINGHOFF

*Attesting Officer*

*Commissioner of Patents and Trademarks*